US006763562B2

(12) United States Patent
Barrios et al.

(10) Patent No.: US 6,763,562 B2
(45) Date of Patent: Jul. 20, 2004

(54) CLUTCH HANDLER

(75) Inventors: Jose O. Barrios, New Richland, MN (US); James E. Jirele, Owatonna, MN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/067,323

(22) Filed: Feb. 7, 2002

(65) Prior Publication Data

US 2003/0089895 A1 May 15, 2003

Related U.S. Application Data

(60) Provisional application No. 60/331,166, filed on Nov. 9, 2001.

(51) Int. Cl.[7] ..... B25B 27/14

(52) U.S. Cl. ..... 29/274; 29/281.1; 29/281.4; 29/244

(58) Field of Search ..... 29/274, 281.1, 29/281.4, 235, 239, 252, 244, 426.5; 254/8 B, 134, 133 R, 124

(56) References Cited

U.S. PATENT DOCUMENTS 6,189,864 B1 * 2/2001 Crow et al. ..... 254/8 B

* cited by examiner

*Primary Examiner*—John C. Hong
(74) *Attorney, Agent, or Firm*—Baker & Hostetler LLP

(57) ABSTRACT

A clutch handler is provided for removal and installation of vehicle parts, such as clutches and the like. The clutch handler comprises a base, a lift arm mechanism including a base end and a distal end, the base end being pivotally mounted to the base by a unique linkage. This linkage allows a clutch to be flipped between the horizontal and the vertical positions without the user's assistance.

18 Claims, 6 Drawing Sheets

CLUTCH HANDLER

PRIORITY

This application claims priority to the provisional patent application, 60/331,166 filed Nov. 9, 2001, the disclosure of which is incorporated herein by reference.

FIELD OF INVENTION

The present invention relates generally to devices for the servicing of heavy-duty truck clutches. More particularly, the present invention relates to clutch handlers.

BACKGROUND OF THE INVENTION

In heavy-duty truck clutches, a mechanic has to manually lower or raise a clutch from the clutch housing to ground level. Due to the weight and size of truck clutches and of the confined space that exists under a vehicle, a few devices have been introduced in the past to assist mechanics with the tasks of removing and installing clutches and components. Because of the low floor clearance found on newer trucks, a particular handler style has become more popular among mechanics. On these cart styles, a clutch can be flipped from a horizontal position to a vertical position to allow the lifting device with the clutch to slide under a truck without having to lift the truck off the floor. Prior art clutch handlers of the type(s) mentioned above include: U.S. Pat. No. 5,190,265, to Barry et al., issued Mar. 2, 1993; U.S. Pat. No. 5,251,875 to Craychee et al., issued Oct. 12, 1993; and U.S. Pat. No. 6,189,864 to Crow et al., issued Feb. 20, 2001 the disclosures of which are incorporated herein by reference.

Furthermore, it is common knowledge that after a certain amount of usage of commercial and recreational vehicles, operative parts thereof, including flywheels, clutches, starters, transmissions, drive shafts, bell housings and the like, wear or breakdown therefore need repair or replacement. Because of the weight, size and shape of such parts, and the confined space in which a mechanic must ordinarily work, handling of such parts, when being removed or installed is time-consuming, strenuous and dangerous unless a properly designed mechanical device is employed.

A conventional mechanical or hydraulic jack is generally unsatisfactory for this purpose because of its failure to provide adequate support for parts of irregular shape, with the resulting danger that the removed part may topple from the jack and injure the mechanic. In addition, use of the conventional jack has been objectionable because such devices have required laborious and time-consuming efforts of the mechanic and usually requires assistance by another mechanic or helper in removing or installing the automotive part being replaced or repaired. The additional effort and assistance are necessary because conventional jacks do not provide a means to adjustably guide the part on the jack so that it can be lifted and returned to its original position. Accordingly, use of these prior-art jacks are costly due to the relatively high costs of labor. Also, conventional jacks are ordinarily limited to movement in vertical directions.

Devices which overcome the foregoing and other drawbacks of conventional hydraulic jacks are known. For example, U.S. Pat. No. 3,948,484, to Tesinsky, issued Apr. 6, 1976, discloses a device to be used in conjunction with a conventional hydraulic jack and for removing a transfer case from an automobile transmission. The device comprises a base mountable to the hydraulic jack and a cradle plate pivotally connected to the base for movement about a horizontal axis of rotation. To remove the crank case from the transmission, the base is mounted over the extensible portion of the jack and the same is raised until the cradle plate engages the crank case and is securely mounted thereto. Subsequently, the plate is pivoted downwardly to tilt the crank out of the way of obstructing parts of the automobile, and then the crank is transported on the jack to a work area for repair.

In addition, U.S. Pat. No. 4,188,010, to Hanscom, issued Oct. 3, 1978, discloses a lifting device comprising, in relevant part, a castered base, an upright support mounted to one side of the base and a boom adapted to pivotally attach to upper or lower portions of the upright support for vertical movement with respect thereto. A hydraulic cylinder is used for actuating pivotal movement of the boom. When the boom is mounted to the top portion of the upright support, the boom functions as a hoist and for this purpose is provided with a hook, chain or cable for lifting. When the boom is mounted to the bottom portion of the upright support, the boom functions as a jacking device for removing and installing automobile transmissions and the like and for this purpose is provided with a cradle tiltably mounted at the rear end of the boom. The cradle can be adjusted to fit various types of transmissions, gear boxes or the like and can be raised or lowered while maintaining a predetermined level relative to the horizontal.

Further, U.S. Pat. No. 2,643,779, to Hamlin, issued Jan. 15, 1949, discloses a jack for handling transmissions and the like during installation and removal of the same and comprising a castered base, a frame at one end of the base, and an arm pivotally secured to the frame. A pneumatic cylinder is secured to and between the frame and the arm and actuates vertical movement of the arm. A cradle is pivotally mounted to the free end of the arm for rotation in the plane of movement of the arm. The transmission is adapted to mount to the cradle. In this manner, the cradle is rotatably adjustable independent of the arm.

Although the devices disclosed above overcome any of the disadvantages associated with conventional jacks, they are not without their own drawbacks. Many of these devices include a boom pivotally mounted to a base and a support pivotally mounted to the free end of the boom to permit the support to maintain a horizontal condition when the boom is moved between upper and lower positions. The support, however, is only rotatable through a horizontal axis of rotation. In addition, although in some instances the support may be adjusted to mount more than one type of automotive part, as disclosed above by Hanscom, in the majority of cases, only one support is provided. Thus, the support is, by its very nature, limited to the types of parts which it can mount and the secureness of the mounting.

The need for the present invention comes from the fact that the prior art does not address the danger of manually flipping a 150-lb. clutch between the horizontal and the vertical positions while lying underneath the truck. When a clutch is flipped between a horizontal position and a vertical position, several things could happen, such as the lifting device moving inadvertently or injury to the hands and back of a user.

Accordingly, it is desirable to provide a clutch handler that overcomes these problems by using a unique linkage structure that allows the clutch to be flipped between a horizontal position to a vertical position without manual assistance.

SUMMARY OF THE INVENTION

The present invention overcomes the need for manually handling heavy clutches and the like when flipping between a horizontal position to a vertical position. In one aspect of the invention, to achieve the desired positioning, a unique linkage is utilized that allows the clutch to be flipped between the horizontal and the vertical positions without direct manual assistance from a user.

In another aspect of the present invention to provide a clutch handler with a unique linkage lift design for moving a clutch from a horizontal position to a vertical position without the risks associated with manually flipping the clutch from a horizontal position to a vertical position, such as injury to a user's hands or back while lifting.

In yet another aspect of the present invention to provide a single hydraulic unit and linkage that can lift the clutch to the height needed for removal or installation of the clutch as well as flip the clutch between the horizontal and vertical positions.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purposes of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

DETAILED DESCRIPTION OF PREFERRED EMBODIMENTS OF THE INVENTION

Figure 1:
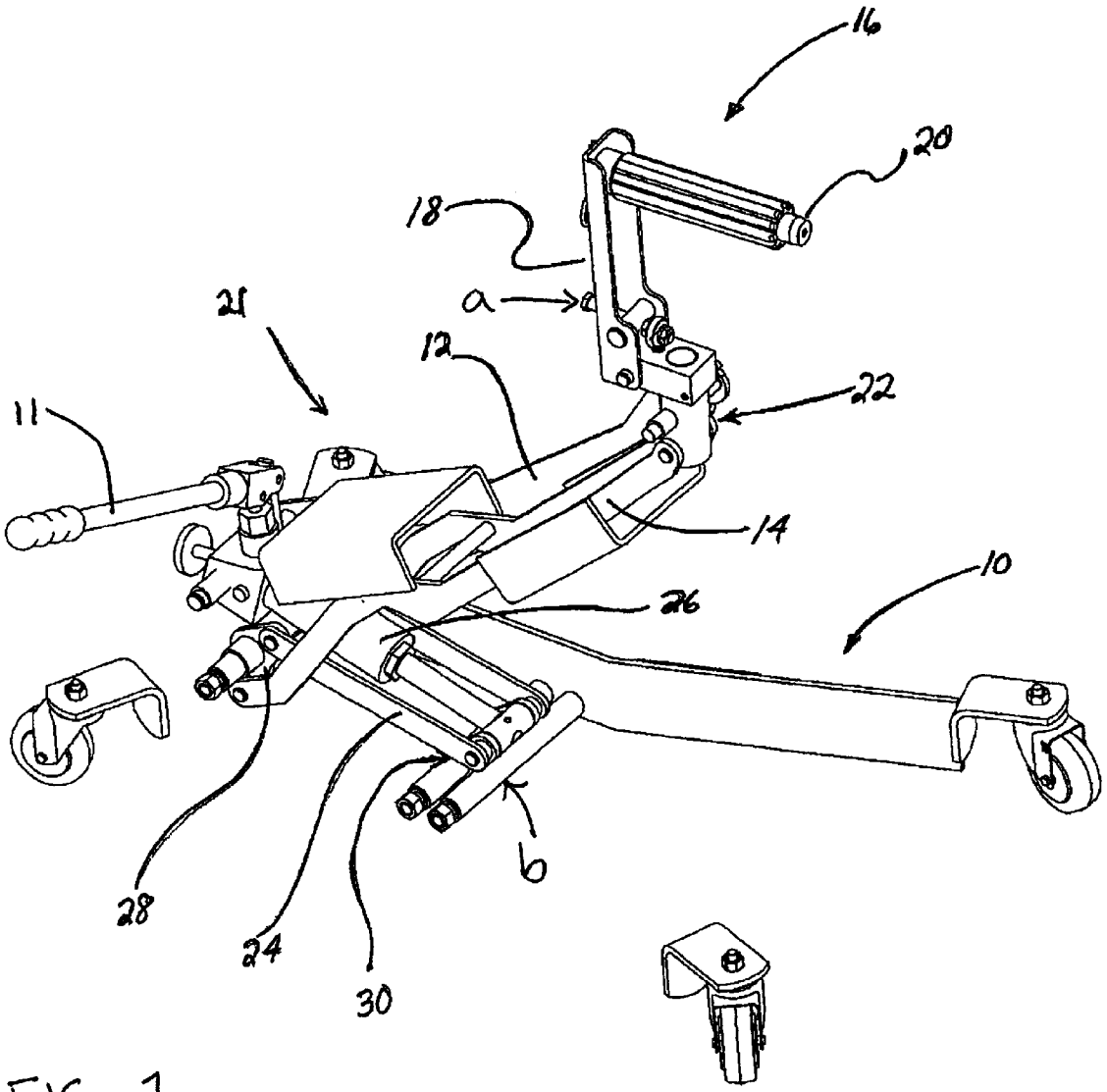
FIG. 1 shows a perspective view of a preferred embodiment of a clutch handler in an extended position with the tilting mechanism.

Now referring to the figures, in FIG. 1 there is shown a fully extended view of one embodiment of the present invention. This embodiment of the present invention is made up of a linkage design 21 having a support 10, a jack handle 11, a lift arm 12, a leveling/tilting linkage 14, a head assembly 16, a shaft bracket 18, a spline shaft 20, a receiver 22, a drag linkage 24, a hydraulic unit 26, an intermediate linkage 28, an adjusting screw (a), a stop bar (b), and a stop linkage 30. It should be noted that identical linkage elements obviously exist and function the same on the opposite side of the above-mentioned linkages 14, 24, 28, and 30, respectively.

Figure 2:
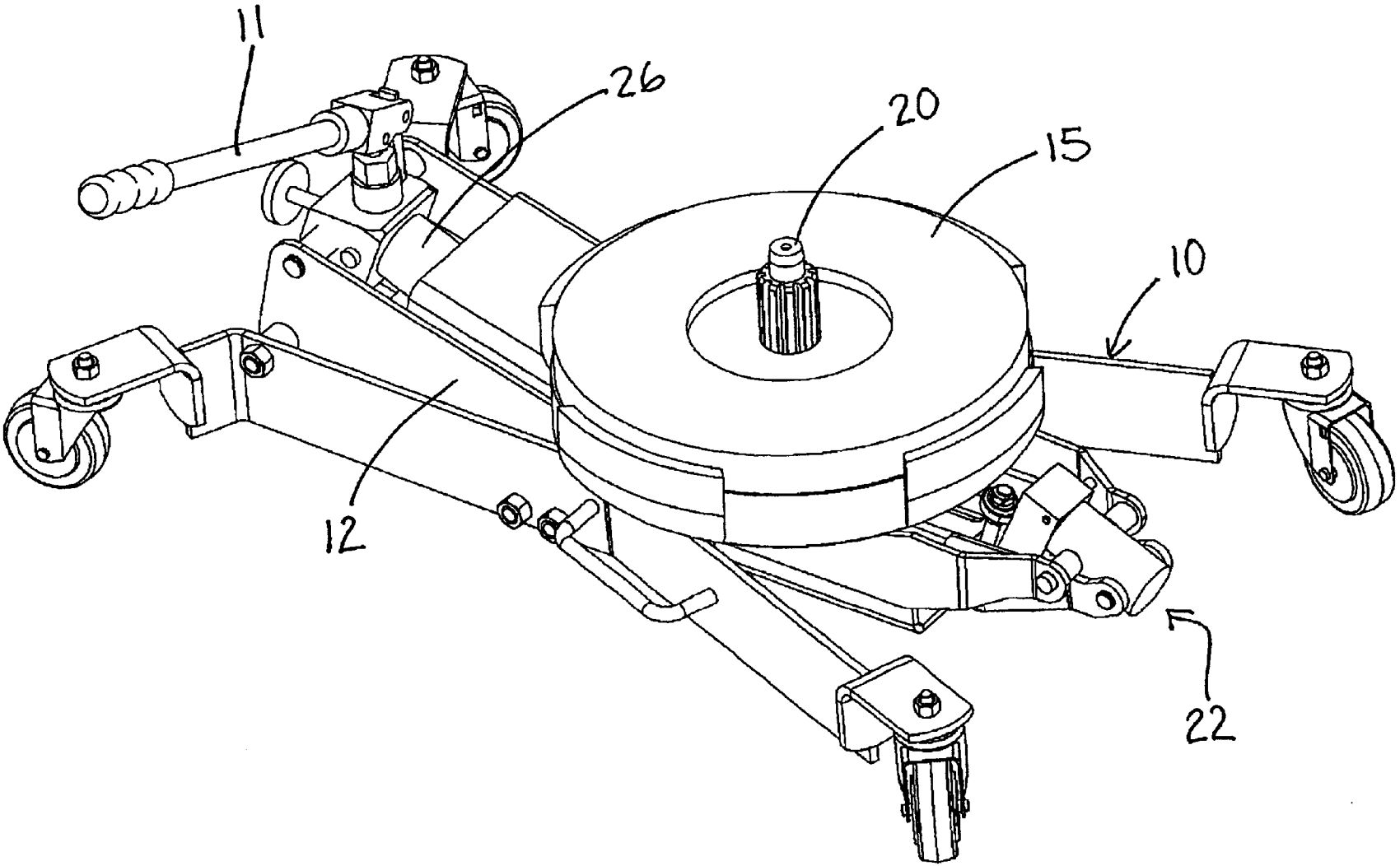
FIG. 2 shows a side perspective view of the clutch handler of FIG. 1 fully retracted and with the spline shaft in the vertical position with a clutch loaded thereon.
Figure 3:
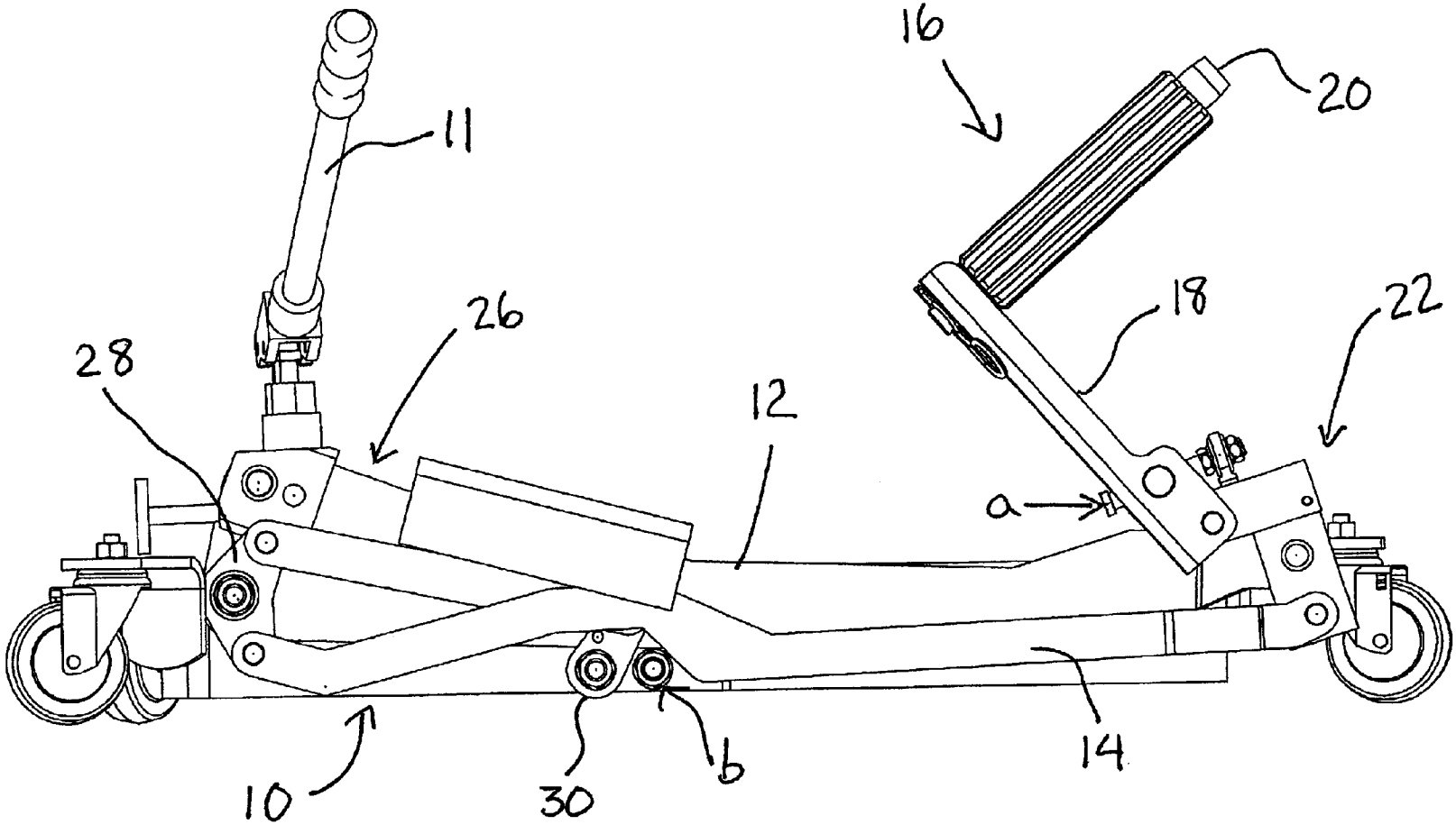
FIG. 3 illustrates a linkage of the clutch handler of FIG. 1 which provides motion to partially tilt the spline shaft from its vertical position.
Figure 4:
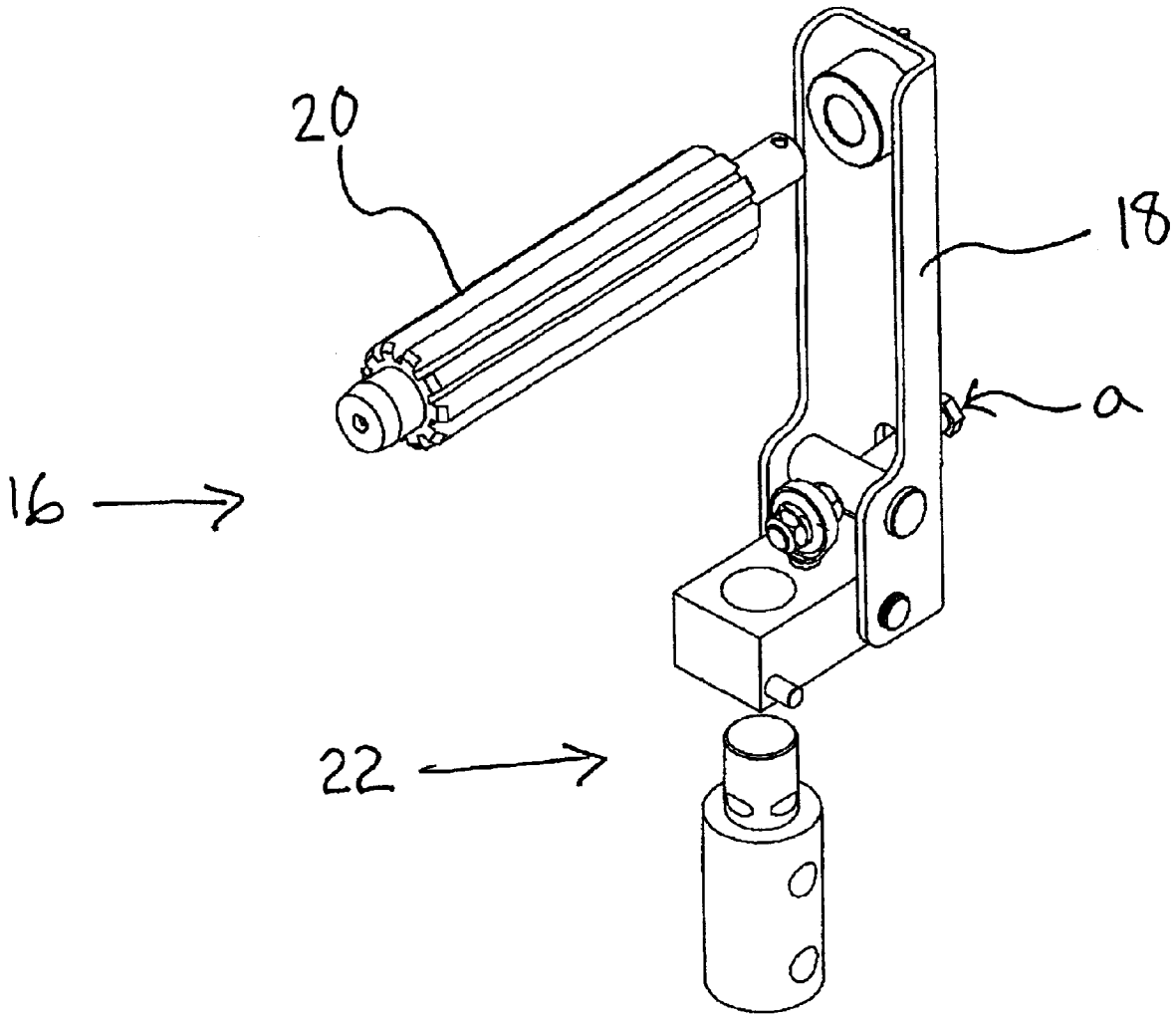
FIG. 4 shows an exploded view of the head assembly of the clutch handler of FIG. 1.
Figure 5:
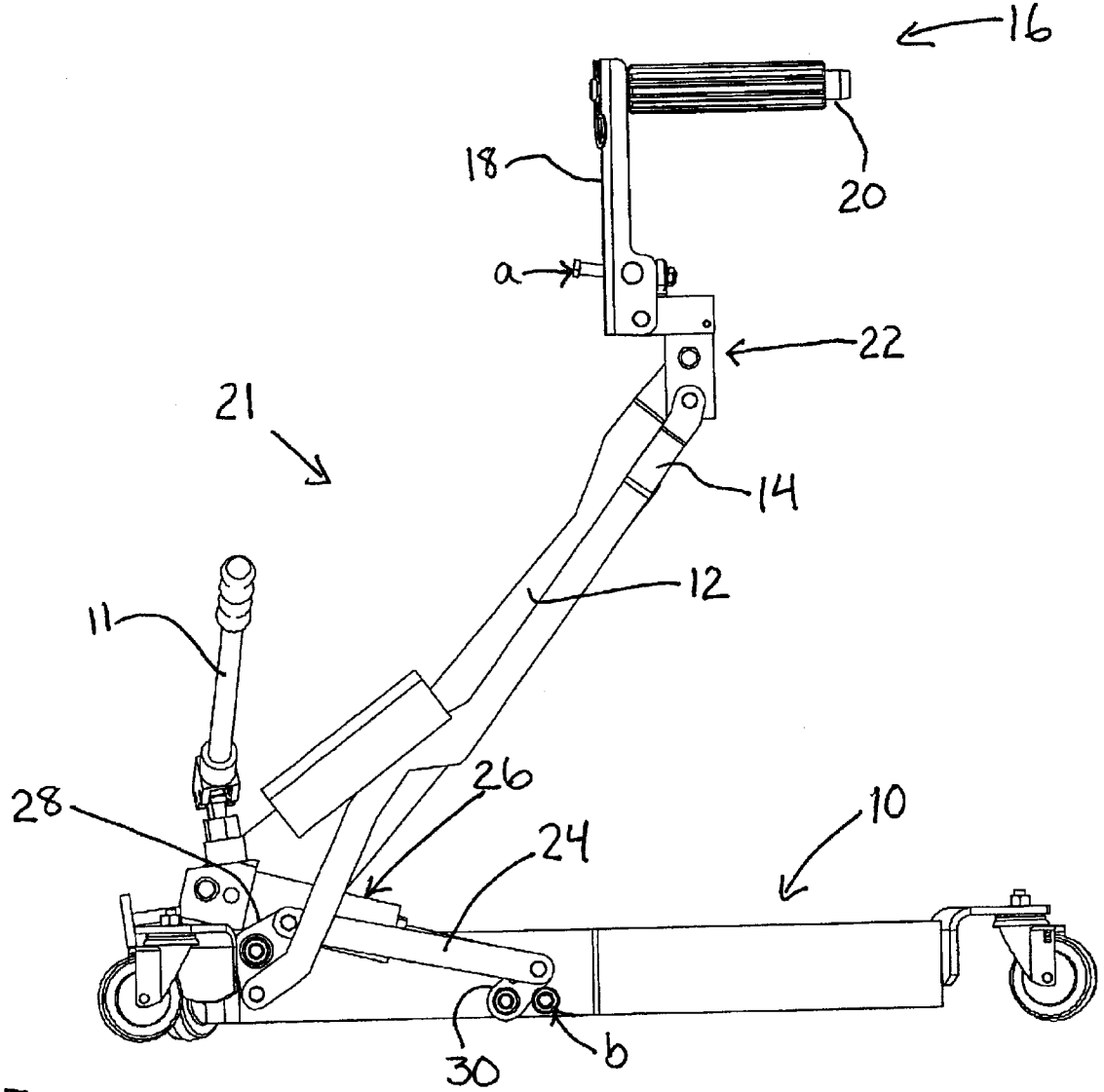
FIG. 5 illustrates a lift arm of the clutch handler of FIG. 1 partially raised with the spline shaft and head assembly maintaining their orientation throughout the lift cycle.
Figure 6:
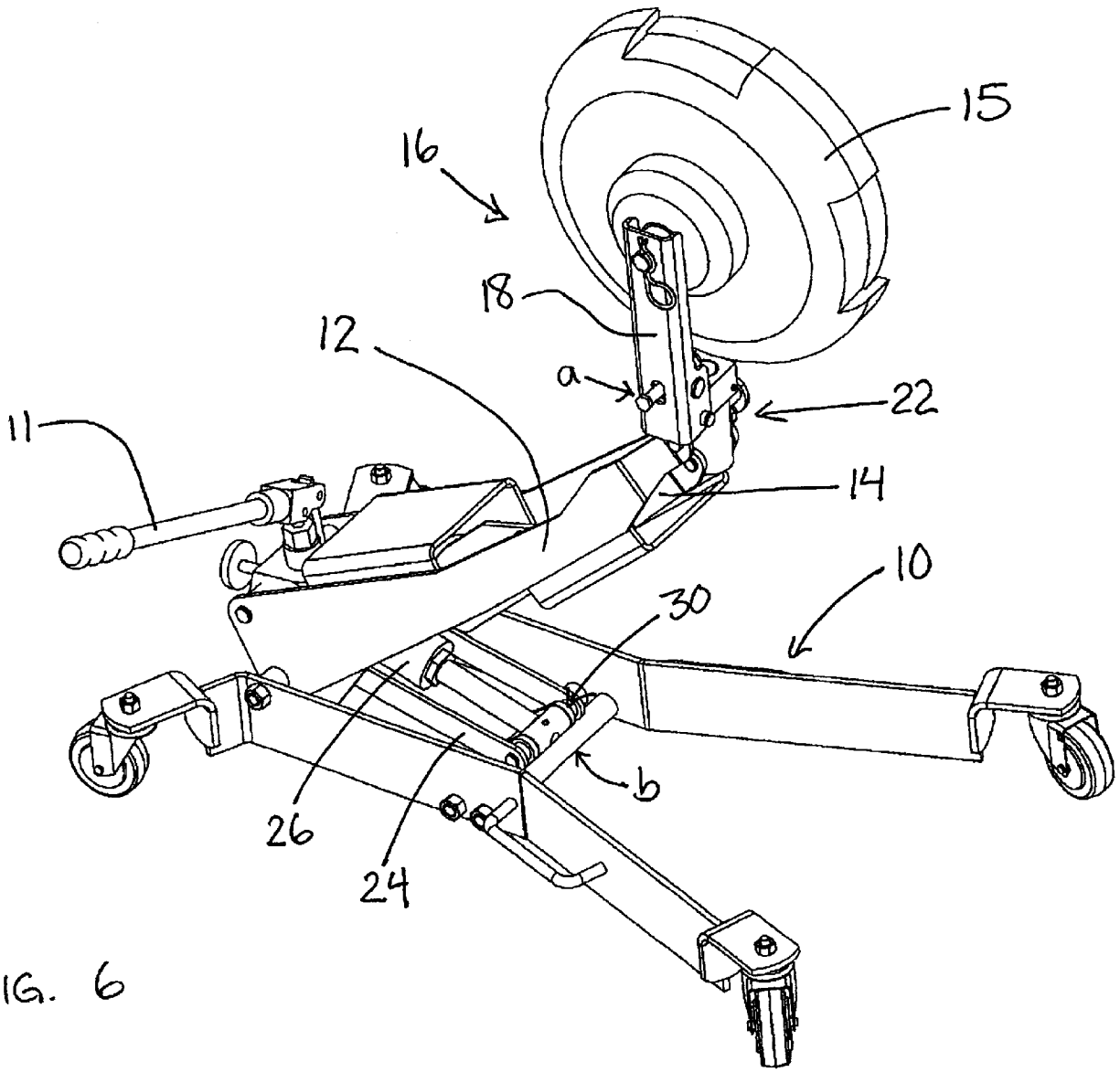
FIG. 6 shows a side view of the clutch handler of FIG. 1 fully extended in the lift cycle with a clutch mounted thereto.

Referring to FIGS. 2 through 6, there is shown one embodiment of the present invention which provides a unique linkage design 21 that allows the clutch 15 to be flipped between the horizontal and the vertical positions without assistance from a user. In FIG. 2 the present invention is fully retracted with the spline shaft 20 in the vertical position ready for loading or unloading. FIG. 3 shows the linkage design 21 that provides motion to partially tilt the spline shaft 20 from its vertical position. FIG. 4 shows the head assembly design 16. FIG. 5 shows the lift arm 12 partially raised with the spline shaft 20 and the head assembly 16 maintaining their orientation throughout the lift cycle. FIG. 6 shows the present invention fully extended in the lift cycle.

Referring to FIGS. 2 and 5, the present invention utilizes the same hydraulic unit 26 to lift the clutch to the height needed for removal or installation of the clutch as it does to flip the clutch between the horizontal and vertical positions. This design eliminates the task for the user to manually flip the clutch assembly while kneeling or lying on a creeper. It also eliminates the potential that the unit will roll away as the clutch is being flipped.

A preferred embodiment of the present inventive apparatus is illustrated in FIG. 1, which shows a tilting mechanism of the present invention in a fully extended position having the stop link 30 abutting the stop bar (b) in order to cause the receiver 22 to pivot the head assembly towards a horizontal position with respect to spline shaft 20. FIG. 2 shows a perspective view of the present invention in a fully retracted position with a spline shaft 20 set in a vertical position for ready loading of a clutch or other vehicle part (not shown). It should be noted that while in this vertical position the stop link 30 and stop bar (b) are not in contact.

In FIG. 3 the linkage provides motion as the hydraulic unit 26 is a piston-cylinder assembly which is pumped by handle 11 or driven by other conventional means to partially tilt the spline shaft 20 from its vertical position shown in FIG. 2 towards a substantially horizontal position as the stop link 30 moves towards stop bar (b). The spline shaft 20 is then tilted to a substantially horizontal position by the tilting linkage 14 pulling and rotating receiver 22 as stop link 30 abuts stop bar (b). The remaining horizontal tilt is obtained by turning the adjusting screw (a) located on the shaft bracket 18.

Referring to FIG. 5, once the tilting linkage 14 abuts the stop bar (b) in a continuous manner, the hydraulic unit 26 raises the lift arm 12. It should be noted that the head assembly 16 and the spline shaft 20 maintain their orientation throughout the lifting cycle (FIGS. 5 & 6). This is important because not all working scenarios have the same height. It should also be noted that other forms of displacement devices may be used in place of the hydraulic unit 26 such as a turn-screw drive or a pneumatic drive (not shown). FIG. 6 illustrates the present invention in a fully extended position with the spline shaft 20 substantially horizontal.

It is to be understood that the invention is not limited in its application to the details of construction and to the arrangements of the components set forth herein the following or illustrated in the drawings. The invention is capable of other embodiments and of being practiced and carried out in various ways. Also, it is to be understood that the phraseology and terminology employed herein, as well as the abstract, are for the purposes of description and should not be regarded as limiting.

The above description and drawings are only illustrative of preferred embodiments which achieve the objects, features, and advantages of the present invention, and it is not intended that the present invention be limited thereto. Any modification of the present invention which comes within the spirit and scope of the following claims is considered to be part of the present invention.

What is claimed is:

1. A clutch handler assembly, comprising:

a lift arm having one end pivotally connected to a support and the other end pivotally connected to a head assembly, a piston-cylinder assembly connected to and between said support and said lift arm, a shaft having an axis connected to a shaft bracket wherein said shaft bracket is pivotally connected to said head assembly, a linkage pivotally connected to said head assembly and to said support about at least three pivot axes, and a stop bar mounted to said support in proximity to said linkage, wherein said piston-cylinder assembly moves said lift arm and said linkage from a lowered position to a raised position and said linkage comprises a pair of at least four movable segments mounted on parallel sides of said lift arm.

2. The clutch handler assembly of claim 1, wherein said shaft is substantially vertical with respect to its axis and said support when said lift arm is in the lowered position.

3. The clutch handler assembly of claim 1, wherein said shaft is substantially horizontal with respect to its axis and said support when said lift arm is in the raised position.

4. The clutch handler assembly of claim 1, wherein said shaft is splined.

5. The clutch handler assembly of claim 1, wherein said piston-cylinder assembly includes a hydraulic pump.

6. The clutch handler assembly of claim 1, wherein said pair of at least four movable segments includes a stop link segment which abuts said stop bar when the linkage is in the raised position and is spaced from said stop bar when the linkage is in the lowered position.

7. The clutch handler assembly of claim 6, wherein said pair of at least four movable segments includes a movable drag link segment connected between a first pivot axis and a second pivot axis.

8. The clutch handler assembly of claim 7, wherein said pair of at least four movable segments includes a tilting link segment connected between said second pivot axis and a third pivot axis connected to said head assembly.

9. The clutch handler assembly of claim 8, wherein said shaft bracket has an adjusting screw mounted thereon for vertical movement of the shaft bracket while in the raised position.

10. The clutch handler assembly of claim 1, wherein said pair of at least four movable segments are configured to pivot said head assembly from a substantially horizontal plane to a substantially vertical plane.

11. A clutch handler assembly comprising:

means for loading a clutch onto a head assembly supported by a lift arm;

means for lifting said head assembly from a substantially horizontal plane to a substantially vertical plane without any manual assistance;

means for moving said clutch handler assembly from a substantially horizontal position to a substantially vertical position, wherein said means for loading is a splined shaft connected to said head assembly and wherein said means for lifting said head assembly from a substantially horizontal plane to a substantially vertical plane is a piston-cylinder assembly which is coupled to a lift arm which is coupled to said head assembly.

12. The clutch handler assembly of claim 11, wherein said means for moving said clutch from a substantially horizontal position to a substantially vertical position is a movable linkage.

13. The clutch assembly of claim 12, wherein said linkage comprises a pair of at least four movable segments mounted on parallel sides of said lift arm.

14. The clutch handler assembly of claim 11, wherein said piston-cylinder assembly includes a hydraulic pump.

15. The clutch handler assembly of claim 13, wherein said pair of at least four movable segments includes a stop link segment which abuts a stop bar when the linkage is in the raised position and is spaced from said stop bar when the linkage is in the substantially horizontal position.

16. The clutch handler assembly of claim 15, wherein said pair of at least four movable segments includes a movable drag link segment connected between a first pivot axis and a second pivot axis.

17. The clutch handler assembly of claim 16, wherein said pair of at least four movable segments includes a tilting link segment connected between said second pivot axis and a third pivot axis connected to said head assembly.

18. The clutch handler assembly of claim 11, wherein said head assembly has an adjusting screw mounted thereon for vertical movement to said substantially vertical position.

* * * * *